US005845669A

United States Patent [19]

Ross

[11] Patent Number: 5,845,669

[45] Date of Patent: Dec. 8, 1998

[54] VENT VALVE

[75] Inventor: Richard J. Ross, Houston, Tex.

[73] Assignee: Baker Hughes Incorporated, Houston, Tex.

[21] Appl. No.: 648,475

[22] Filed: May 16, 1996

[51] Int. Cl.[6] ..... F16K 17/40

[52] U.S. Cl. ..... 137/68.3

[58] Field of Search ..... 137/68.3, 68.29

[56] References Cited

U.S. PATENT DOCUMENTS

| | | | |
|---|---|---|---|
| 2,947,315 | 8/1960 | Connell | 137/68.3 |
| 2,958,545 | 11/1960 | Stelzer | 137/68.3 |
| 3,424,181 | 1/1969 | Morse | 137/68.3 |
| 3,633,596 | 1/1972 | Gerber | 137/68.3 |
| 3,989,057 | 11/1976 | Muddiman | 137/68.29 |
| 4,079,854 | 3/1978 | Shaw et al. | 137/68.3 |
| 4,286,662 | 9/1981 | Page, Jr. . | |
| 5,495,865 | 3/1996 | Wass et al. | 137/68.3 |

*Primary Examiner*—Marguerite McMahon
*Attorney, Agent, or Firm*—Rosenblatt & Redano P.C.

[57] ABSTRACT

A bleed valve design for a wireline pressure setting tool is disclosed. The chamber within the setting tool is vented through a bleed valve assembly which features a rupture disk secured over an opening with an O-ring seal. A piercing tool is used and in conjunction with the shape of the rupture disk creates a break in the rupture disk in a manner that will not reseal. Lateral passages are provided to direct the vented gases away from operating personnel. An alternative venting mechanism is provided by having a thin wall segment which can be penetrated by a piercing tool in the event the rupture disk assembly for any reason fails to allow venting of the setting tool.

21 Claims, 3 Drawing Sheets

VENT VALVE

FIELD OF THE INVENTION

The field of this invention relates to vent valves, particularly those useful to vent accumulated pressure from inside wireline actuated setting tools.

BACKGROUND OF THE INVENTION

In the past, packers and other tools have been run into a wellbore on a wireline with a setting tool. The purpose of the setting tool was to create relative movement to set the packer or other downhole tool while disengaging from it after it is set. Typically, such tools would generate pressure internally which would create relative movement required for setting the packer. At the conclusion of the relative movement, the setting tool would release from the packer so that it could be brought to the surface on a wireline.

When such setting tools were brought to the surface, any residual internal pressure needed to be bled off prior to disassembly of the tool.

Those types of wireline setting tools that used a chemical reaction to create the internal pressure would generally also generate fairly high temperatures for brief periods of time in the order of 2,500–3,000 degrees F. The ambient well temperature was usually 400–500 degrees F. or less, which meant that the setting tool would ultimately reach an equilibrium temperature far below its peak temperature. However, these spikes of high temperature had, in the past, affected sealing mechanisms used in conjunction with bleed valve assemblies for wireline-type setting tools. A typical known wireline pressure setting assembly is illustrated in FIGS. 1 and 2. As shown in FIG. 1, the tool creates pressure within a chamber 10 due to a chemical reaction. The bleed valve assembly is illustrated in FIG. 2, which is a section view along lines 2—2 of FIG. 1. As shown in FIG. 2, the setting tool has a body 12. Body 12 surrounds passage 14, which is an extension of chamber 10. Body 12 has a threaded recess 16 within which is mounted ring 18. Ring 18 is sealed against recess 16 by an O-ring seal 20. Ring 18 has an opening 22 which is in full communication with the passage 14. A plug 24 is threadedly engaged into a retainer 26 which is itself threadedly engaged to the recess 16 at thread 28. O-ring seal 30 seals between the plug 24 and ring 18. Between ring 18 and retainer 26 is radial passage or passages 32 which are in flow communication with passage 34 in body 12. The plug 24 has a hex recess 36 for accepting a wrench to operate the assembly. When it is time to relieve the internal pressure from chamber 10 and passage 14 at the surface, a wrench is inserted into recess 36 and the plug 24 is rotated counterclockwise until the O-ring seal 30 clears past passage or passages 32 at which point pressure, if any, within chamber 10 or passage 14 will pass around plug 24 into passages 32 and ultimately out passage 34.

One of the operational issues in this prior design has been the effective temperature on the seal rings, such as 20 and 30. When such seals were exposed to significant temperatures downhole, as chemicals reacted to create the pressure in chamber 10, their integrity became less than certain. This created a potential problem for surface personnel handling the setting tool at the surface after it has been used since the ability of the seals 20 and 30 to retain the pressure until it was desired to vent was in some doubt.

Reuse of the parts illustrated in FIG. 2 was also a concern since the high velocities involved during venting could cause, due to erosion, potential problems with resealing for a subsequent reuse. Alternatively, the setting tool may only partially actuate if a leak was present in the prior assembly. This could result in the packer being set without the setting tool releasing from it. If this occurred, the wireline would be disconnected and an expensive fishing operation would have to be undertaken.

Accordingly, one of the objects of the present invention is to provide an improved bleed valve arrangement which will be resistant to the velocity and/or temperature effects experienced during the bleeding operation and during the setting of the tool, itself. Another objective is to provide a back-up method so that even if the main method of bleeding off pressure is for any reason not serviceable, a back-up method is available to still allow venting of the tool in a safe and proper manner. Another objective of the invention is to provide a simple design that improves reliability and which can be produced more economically. These and other objectives of the present invention will be better understood by a review of the detailed description which follows below.

SUMMARY OF THE INVENTION

A bleed valve design for a wireline pressure setting tool is disclosed. The chamber within the setting tool is vented through a bleed valve assembly which features a rupture disk secured over an opening with an O-ring seal. A piercing tool is used and in conjunction with the shape of the rupture disk creates a break in the rupture disk in a manner that will not reseal. Lateral passages are provided to direct the vented gases away from operating personnel. An alternative venting mechanism is provided by having a thin wall segment which can be penetrated by a piercing tool in the event the rupture disk assembly for any reason fails to allow venting of the setting tool.

DETAILED DESCRIPTION OF THE PREFERRED EMBODIMENT

Figure 1:
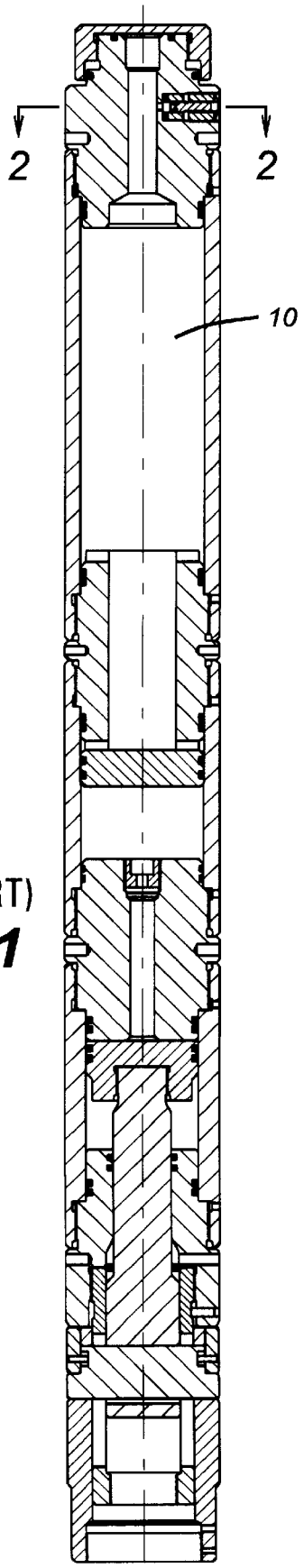
(PRIOR ART) FIG. 1
FIG. 1 is a sectional elevational view of a known wireline-type pressure setting tool.
Figure 2:
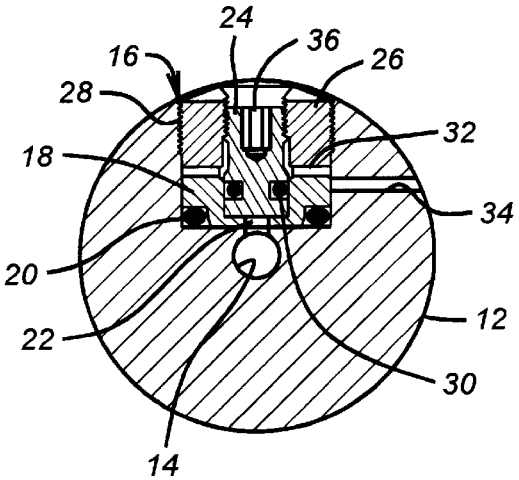
(PRIOR ART) FIG. 2
FIG. 2 is the view along lines 2—2 of FIG. 1 showing the bleed valve assembly of the known tool design.
Figure 3:
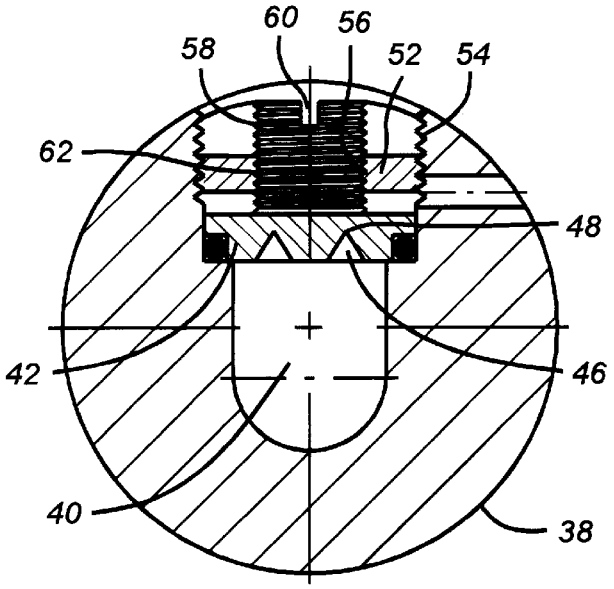
FIG. 3 shows the bleed valve assembly of the present invention in the run-in position.

FIG. 3 illustrates in section the body 38 which in most respects corresponds to the shape of the body 12 illustrated in FIG. 2. There is an internal passage 40 which is where the developed pressure is created in order to actuate the wireline setting tool of the type that is illustrated in FIG. 1. The valve assembly of the present invention is illustrated in FIG. 3. A rupture disk member 42 is held against the body 38 and the connection is sealed by O-ring 44. The rupture disk 42 in the preferred embodiment has a circular notch 46. The presence of the circular notch creates weak break point 48, whose purpose will be described below. Other ways of creating weak points are within the scope of the invention. A retainer 52 engages the body 38 at thread 54. Retainer 52 itself has a threaded opening 56 to accept a preferably Teflon® filler plug 58. Plug 58 has a slot 60 to facilitate insertion and removal with a screw driver. The purpose of plug 58 is to protect thread 62 so that when the penetrating tool 64 is later inserted into thread 62, the thread will be clean and free from foreign matter.

Disk 42 can also be retained by equivalent structures such as a snap ring put into a groove which is located just above the disk 42. If done this way, the thread 68 engages thread 54 directly. Direct engagement of thread 68 to thread 54 is considered equivalent to indirect engagement via thread 56 of retainer 58. In both cases, the tool 64 is "engaged to the body 38."

Figure 4:
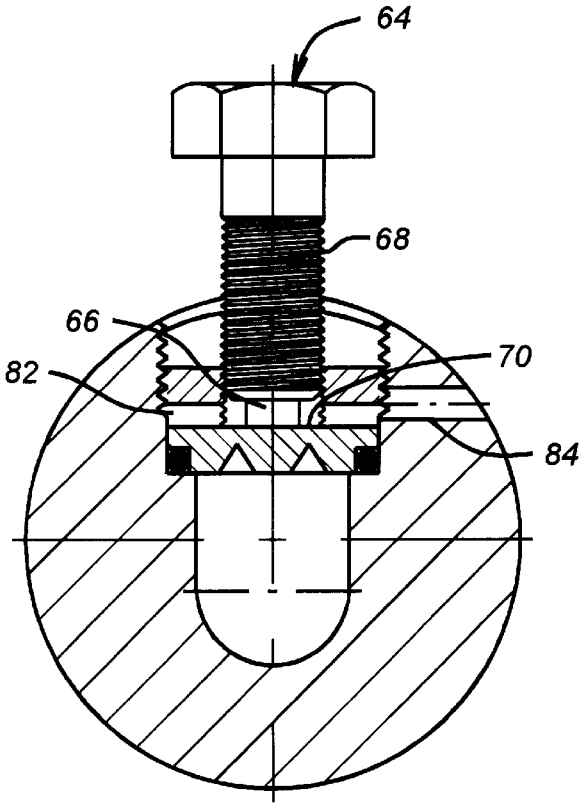
FIG. 4 shows the bleed valve assembly of the present invention just prior to breakage with the piercing tool.
Figure 5:
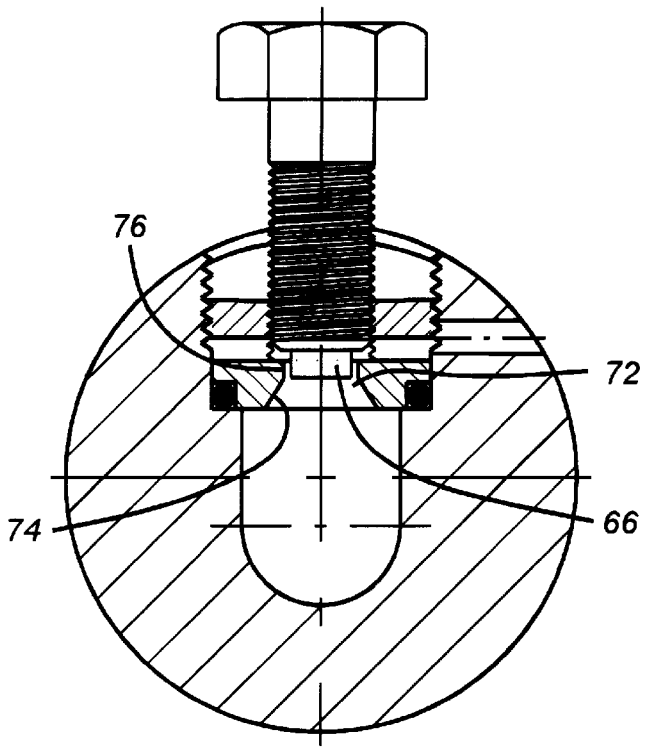
FIG. 5 shows the bleed valve assembly of FIG. 4 after the rupture disk has been broken with the piercing tool.
Figure 6:
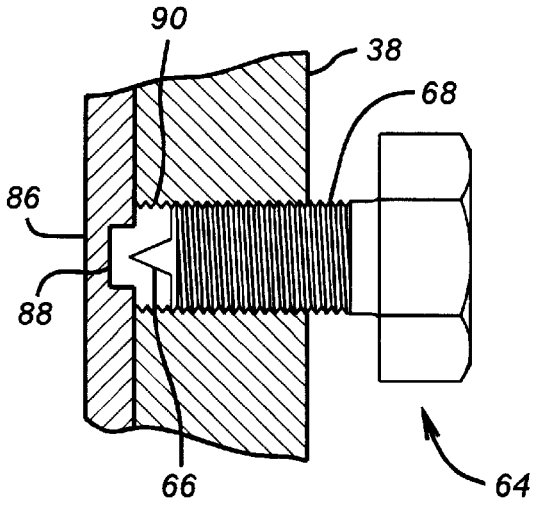
FIG. 6 shows a back-up system involving the use of a piercing tool to break through a thin wall portion of the tool.

The assembly as shown in FIG. 3 is run into the wellbore and the setting tool is energized by chemical reaction involving pressure build-up in passage 40. The rupture disk is constructed to be able to handle the expected pressures and temperatures. As compared to the prior design illustrated in FIG. 1, there is only one O-ring seal and the rupture disk, once broken, is replaced for subsequent operations. The O-ring 44 is also replaced when the rupture disk 42 is broken with the tool 64. When it is time to vent the pressure in passage 40 and the tool has been retrieved to the surface, the plug 58 is removed with a screw driver inserted into slot 60. The tool 64, which is basically a bolt with preferably a cylindrical projection 66 below the threads 68 as shown in FIG. 6. The projection can have other shapes such as an inverted cone. As shown in FIG. 4, the projection 66 engages the flat side 70 of the rupture disk 42. As the bolt or tool 64 is advanced by turning, the rupture disk 42 ultimately breaks at the weak point 48. The center of the rupture disk 42 fall into the passage 40 and the result is illustrated in FIG. 5 with the projection 66 extending into an opening 72 which has now a tapered shape 74. Above the taper 74 is a generally cylindrical opening 76 which is bigger in diameter than the projection 66 to prevent any resealing between the rupture disk 42 and the projection 66 after the rupture disk 42 is broken.

Figure 7:
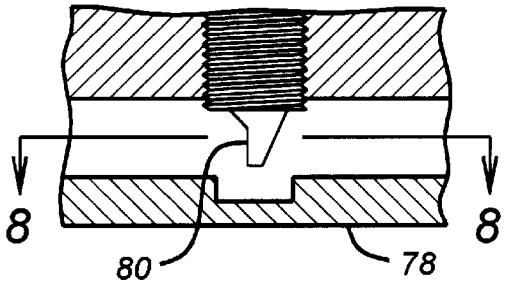
FIG. 7 is a sectional elevational view of the rupture disk in an alternative form with an alternative design for the piercing tool.

As an alternative to providing the weakened section 48, a rupture disk 78 illustrated in FIG. 7 may be used. This rupture disk 78 is a basic flat disk which is penetrated by a tool having a projection 80. A recess 79 is in the top to facilitate penetration. The cross-section of the projection can be smaller than a full circle, such as a semi-circle illustrated in FIG. 8 or any other shape which when rotated with the tool 64 will make an opening in disk 78 larger than its own cross-sectional area. Any shape mounted off center to the longitudinal axis of the tool 64 will also accomplish this result. When the puncture tool 64 is operated using a cross-sectional area, such a semi-circle illustrated in FIG. 8, it will make a circular opening in the rupture disk 78. Since the cross-sectional area of the projection 80 of the puncture tool 64 in the embodiment of FIG. 7 is something other than a complete cylindrical shape, rotating the puncture tool 64 will prevent resealing of the circular opening around the projection 80 because the projection 80 has a different and smaller shape than the circular opening which it makes. Once the rupture disk 42 or 78 is broken, flow commences through passage 82 and out through passage 84. There may be some blow by through the connection around threads 68; however, the volume should be minimal due to the fact that the path of least resistance is through passages 82 and 84.

Figure 8:
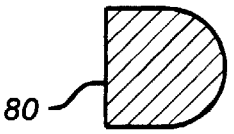
FIG. 8 is a section view along lines 8—8 of FIG. 7.

In the event that the bleed valve assembly, illustrated in FIGS. 3–5, for any reason fails to operate, the body 38 can have a thin-walled section 86 elsewhere along its length as illustrated in FIGS. 7 and 8. This creates a recess 88 into which the puncture tool 64 can enter. A thread 90 is provided to engage the thread 68 on puncture tool 64. For run-in purposes, a plug (not shown) similar to plug 58 can be used to keep the threads 90 clean. Upon sufficient advancement of the puncture tool 64, its projection 66 advances through the thin-walled section 86 to provide a back-up method of emergency venting should the assembly, shown in FIGS. 3–5 or 7–8, for any reason be inoperative. In the situation shown in FIGS. 7 and 8, the venting will be around thread 90 unless the body 38 is made with a separate passage to direct the venting through another outlet.

Accordingly, those skilled in the art will now appreciate that through the use of a rupture disk design a simpler and more reliable technique of bleeding pressure off of a tool that has a pressurized compartment has been disclosed. The illustrated bleed technique is applicable to a wide variety of tools, but is most specifically useful for wireline setting tools particularly used for setting packers. The number of leak paths is reduced by the present design when compared to the prior design which had been in use for many, many years. The venting technique is more certain with the newly disclosed arrangement and with a simple replacement of a rupture disk and an O-ring, the tool is ready for reuse. Thus, the need to carry an inventory of small internal parts which could potentially be damaged by generated heat or velocity affects during venting has been eliminated. While simplifying the design, the safety aspects have been retained so that the energy of the vented gases is directed away from operating personnel during the venting operation.

The foregoing disclosure and description of the invention are illustrative and explanatory thereof, and various changes in the size, shape and materials, as well as in the details of the illustrated construction, may be made without departing from the spirit of the invention.

I claim:

1. A venting assembly for pressure relief of a downhole tool body prior to disassembly, comprising:

a downhole tool body;

a rupture disk mountable to said body over a vent passage thereon;

a puncturing member threadedly engageable with said body such that upon advancement by manual rotation of said puncturing member into contact with said rupture disk, it breaks said rupture disk while said puncturing member is still engaged to the body to vent pressure from said body.

2. The venting assembly of claim 1, wherein:

said rupture disk is formed having a thinned portion which preferentially breaks under the force of said puncturing member.

3. The venting assembly of claim 2, wherein:

said puncturing member comprises a projection which contacts said disk to break it.

4. The venting assembly of claim 3, wherein:

said projection is cylindrically shaped.

5. The venting assembly of claim 4, wherein:

said cylindrically shaped projection has a diameter smaller than the portion of said rupture disk which is broken out due to the presence of said thinned portion.

6. The venting assembly of claim 5, wherein:

said thinned portion is defined by a circular notch on at least one side of said rupture disk.

7. The venting assembly of claim 2, wherein:

said puncturing member is fully engaged by its thread before it advances sufficiently to break said rupture disk whereupon said thread prevents a substantial portion of the vented gas from passing thereby to allow such gas to escape elsewhere through said body.

8. The venting assembly of claim 1, wherein:

said puncturing member comprises a thread for engagement with the body;

said venting assembly further comprises:

a retainer mounted to the body, said retainer having a thread thereon which accepts said thread of said puncturing member, said thread on said retainer protected while downhole by an insert in engagement with said thread on said retainer.

9. The venting assembly of claim 1, further comprising:

a retainer held by said body having a threaded opening thereon;

said retainer accepting said puncturing member in said threaded opening.

10. The venting assembly of claim 9, further comprising:

a protective plug insertable in said opening of said retainer while said body is located downhole to protect said thread in said opening on said retainer until said puncturing member is to be inserted.

11. The venting assembly of claim 10, wherein:

said rupture disk is notched to promote failure having a predetermined portion of said disk.

12. The venting assembly of claim 11, wherein:

said puncturing member comprises a bolt having a projection at one end thereof.

13. The venting assembly of claim 12, further comprising:

said projection is cylindrical with a diameter smaller than the portion of said rupture disk which is pushed out due to said notch.

14. The venting assembly of claim 13, wherein:

said body is formed having a vent passage;

said threaded engagement of said puncturing member to the body directs vented gas substantially through said vent passage.

15. The venting assembly of claim 14, wherein:

said body has a thin section in communication with said chamber and an emergency passage having a thread thereon beyond said thin section;

whereupon if for any reason said puncturing member fails to break said disk, a puncturing member can be engaged in said emergency passage and advanced until it breaks through said thin section.

16. The venting assembly of claim 8, wherein:

said thread on said retainer is protected while downhole by an insert in engagement with said thread on said retainer.

17. The venting assembly for a downhole tool comprising:

a tubular tool body defining a chamber therein which is still potentially pressurized after use and retrieval to the surface;

said chamber having a vent passage through said body;

a rupture disk to sealingly cover said passage;

a puncturing member threadedly insertable in said passage such that it can be manually advanced toward the rupture disk and ultimately break it to vent said body while said puncturing member is still threadedly retained to said body.

18. The venting assembly of claim 17, wherein:

said body has a thin section in communication with said chamber and an emergency passage having a thread thereon beyond said thin section;

whereupon if for any reason said puncturing member fails to break said disk, a puncturing member can be engaged in said emergency passage and advanced until it breaks through said thin section.

19. A venting assembly for pressure relief of a downhole tool body prior to disassembly comprising:

a rupture disk mountable to said body over a vent passage thereon;

a puncturing member movably engageable with said body such that upon advancement into contact with said rupture disk, it breaks said rupture disk while said puncturing member is still engaged to the body;

said puncturing member comprises a thread for engagement with the body;

said puncturing member comprises a projection which contacts said disk to break it;

said projection is mounted off center to the longitudinal axis of said puncturing member so that when said puncturing member is rotated an opening in said rupture disk is made which is larger than the cross-sectional area of said projection.

20. A venting assembly for a downhole tool comprising:

a tubular tool body defining a chamber therein which is still potentially pressurized after use and retrieval to the surface;

said chamber having a vent passage through said body;

a rupture disk to sealingly cover said passage;

a puncturing member insertable in said passage such that it can advance toward the rupture disk and ultimately break it while said puncturing member is still retained to said body;

a retainer held by said body having a threaded opening thereon;

said retainer accepting said puncturing member in said threaded opening;

said puncturing member is formed having a thread thereon;

a protective plug insertable in said opening of said retainer while said body is located downhole to protect said thread in said opening on said retainer until said puncturing member is to be inserted;

said puncturing member comprises a bolt having a projection at one end thereof; and said projection, when said puncturing member is turned, forms an opening in said rupture disk that has a larger cross-sectional area than the cross-sectional area of said projection.

21. A venting assembly for a downhole tool comprising:

a tubular tool body defining a chamber therein which is still potentially pressurized after use and retrieval to the surface;

said chamber having a vent passage through said body;

a rupture disk to sealingly cover said passage;

a puncturing member insertable in said passage such that it can advance toward the rupture disk and ultimately break it while said puncturing member is still retained to said body;

said puncturing member comprises a bolt having a projection at one end thereof; and said projection, when said puncturing member is turned, forms an opening in said rupture disk that has a larger cross-sectional area than the cross-sectional area of said projection.

* * * * *